US007503535B2

(12) United States Patent
Ziaylek

(10) Patent No.: US 7,503,535 B2
(45) Date of Patent: Mar. 17, 2009

(54) MOUNTING BRACKET FOR DETACHABLE HOLDING OF A CYLINDRICAL TANK

(76) Inventor: Michael Paul Ziaylek, 15 Cold Spring Ave., Yardley, PA (US) 19067

( * ) Notice: Subject to any disclaimer, the term of this patent is extended or adjusted under 35 U.S.C. 154(b) by 379 days.

(21) Appl. No.: 11/517,895

(22) Filed: Sep. 8, 2006

(65) Prior Publication Data

US 2008/0078911 A1 Apr. 3, 2008

(51) Int. Cl.
*A47K 1/08* (2006.01)

(52) U.S. Cl. ..... 248/313; 348/154; 348/505

(58) Field of Classification Search ..... 248/313, 248/154, 307, 311.2, 505, 499
See application file for complete search history.

(56) References Cited

U.S. PATENT DOCUMENTS

| | | | | |
|---|---|---|---|---|
| 1,911,781 | A | | 5/1933 | Wolfe, Jr. |
| 2,168,136 | A | | 8/1939 | Playfair et al. |
| 2,431,698 | A | | 12/1947 | Lombard |
| 2,615,238 | A | * | 10/1952 | Highwood ..... 269/9 |
| 2,903,225 | A | | 9/1959 | Weinstein |
| 3,193,232 | A | | 7/1965 | Hatcher |
| 3,224,720 | A | | 12/1965 | Hain |
| 3,317,171 | A | | 5/1967 | Kramer |
| 3,547,391 | A | | 12/1970 | Johnson |
| 3,565,384 | A | | 2/1971 | Lockwood |
| 3,603,550 | A | | 9/1971 | Byrd |
| D222,527 | S | | 11/1971 | Ziaylek, Jr. |
| 3,737,133 | A | | 6/1973 | Boecker |
| 3,780,972 | A | | 12/1973 | Brodersen |
| 3,823,907 | A | | 7/1974 | Ziaylek, Jr. |
| D237,357 | S | | 10/1975 | Ziaylek, Jr. |
| D245,929 | S | | 9/1977 | Montambo |
| 4,150,806 | A | * | 4/1979 | Dziuk ..... 248/154 |
| 4,213,592 | A | | 7/1980 | Lingenfelser |
| D267,227 | S | | 12/1982 | Ziaylek, Jr. |
| 4,379,541 | A | | 4/1983 | Harkness |
| 4,391,377 | A | | 7/1983 | Ziaylek, Jr. |
| 4,586,687 | A | | 5/1986 | Ziaylek, Jr. |
| D298,704 | S | | 11/1988 | Ziaylek, Jr. |
| 4,848,714 | A | | 7/1989 | Ziaylek, Jr. et al. |
| D303,738 | S | | 10/1989 | Ziaylek, Jr. |
| 4,905,950 | A | | 3/1990 | Turner et al. |
| 4,971,275 | A | | 11/1990 | Roberts |
| D314,325 | S | | 2/1991 | Ziaylek, Jr. et al. |
| 4,997,157 | A | | 3/1991 | Sweeny |
| D319,778 | S | | 9/1991 | Ziaylek, Jr. |
| 5,071,100 | A | | 12/1991 | Sweeny |
| 5,190,260 | A | | 3/1993 | Daubenspeck |
| D342,666 | S | | 12/1993 | DePack |
| 5,314,233 | A | | 5/1994 | Bostrom et al. |
| D347,735 | S | | 6/1994 | Ziaylek, Jr. et al. |

(Continued)

*Primary Examiner*—J. Allen Shriver, II
*Assistant Examiner*—Bradley H Duckworth
(74) *Attorney, Agent, or Firm*—Sperry, Zoda & Kane

(57) ABSTRACT

A bracket for holding of cylindrical tanks such as emergency breathing tanks adjacent to a wall surface or behind a seat surface in a detachable manner with positive engagement released by an operative release line. An upper and lower securement strap are secured together at an engaging tab which straps extend around the tank when the tab is engaged and can be easily released for rapid exit. A webbing extends between the upper and lower securement straps for minimizing any entanglements or catching of the straps on protruding portions of the tank.

22 Claims, 6 Drawing Sheets

U.S. PATENT DOCUMENTS

| | | | |
|---|---|---|---|
| 5,354,029 | A | 10/1994 | Ziaylek, Jr. et al. |
| 5,362,022 | A | 11/1994 | McLoughlin et al. |
| 5,579,967 | A | 12/1996 | Berg |
| 5,607,133 | A | 3/1997 | Markham et al. |
| 5,681,080 | A | 10/1997 | Pond et al. |
| D394,381 | S | 5/1998 | Ziaylek, Jr. et al. |
| 5,810,089 | A | 9/1998 | Mack |
| D419,317 | S | 1/2000 | Pond |
| D424,414 | S | 5/2000 | Ziaylek et al. |
| 6,113,004 | A | 9/2000 | Steingass et al. |
| 6,220,557 | B1 | 4/2001 | Ziaylek et al. |
| 6,543,736 | B2 | 4/2003 | Field |
| 6,601,923 | B2 | 8/2003 | Pond et al. |
| D480,294 | S | 10/2003 | Ziaylek, Jr. et al. |
| 6,655,745 | B2 | 12/2003 | Fohrenkamm et al. |
| 6,685,153 | B2 | 2/2004 | Foreman |
| 6,702,242 | B1 | 3/2004 | Ziaylek, Jr. et al. |
| D494,049 | S | 8/2004 | Ziaylek et al. |
| D494,453 | S | 8/2004 | Ziaylek et al. |
| 6,769,659 | B1 | 8/2004 | Martello |
| 6,883,766 | B1 | 4/2005 | Ziaylek et al. |
| 6,926,243 | B1 | 8/2005 | Ziaylek et al. |
| D510,015 | S | 9/2005 | Hostetler |
| D558,566 | S * | 1/2008 | Ziaylek ..... D8/373 |
| 2006/0076820 | A1 | 4/2006 | Lackore |

* cited by examiner

MOUNTING BRACKET FOR DETACHABLE HOLDING OF A CYLINDRICAL TANK

BACKGROUND OF THE INVENTION

1. Field of the Invention

The present invention deals with configurations of devices designed to hold cylindrical tanks such as self-contained breathing apparatus and other similar tanks such as air tanks vertically with respect to walls and/or seats such as on fire trucks or in fire stations to facilitate storage thereof and yet allow emergency personnel to quickly exit the area while wearing or otherwise holding of such breathing assistance gear. These devices are designed to preferably hold cylindrical tanks vertically in a tank holding zone to facilitate rapid and convenient deployment thereof for users, most particularly emergency works. Such devices are often used on the seatback of seats and fire trucks or on the walls of fire stations or in lockers within fire stations.

2. Description of the Prior Art

A number of various prior art devices have been patented for the purposes of holding cylindrical tanks, some vertically with respect to planar surfaces such as walls or seatbacks, such as shown in U.S. Design Pat. No. Des. 222,527 patented Nov. 2, 1971 to T. Ziaylek, Jr. on a "Bracket For Use With Lifesaving Equipment"; and U.S. Design Pat. No. Des. 237,357 patented Oct. 28, 1975 to T. Ziaylek, Jr. and assigned to Ziamatic Corporation on a "Tank Support Bracket For Lifesaving Equipment"; and U.S. Design Pat. No. Des. 245,929 patented Sep. 27, 1977 to R. Montambo and assigned to The Ansul Company on a "Fire Extinguisher Bracket"; and U.S. Design Pat. No. Des. 267,227 patented Dec. 14, 1982 to T. Ziaylek, Jr. and assigned to Ziamatic Corporation on a "Support Bracket For A Gas Cylinder"; and U.S. Design Pat. No. Des. 298,704 patented Nov. 29, 1988 to T. Ziaylek, Jr. on a "Seat For Use Primarily In Emergency Vehicles"; and U.S. Design Pat. No. Des. 303,738 patented Oct. 3, 1989 to T. Ziaylek, Jr. on a "Rotatable Cylinder Holder"; and U.S. Design Pat. No. Des. 314,325 patented Feb. 5, 1991 to T. Ziaylek, Jr. et al on a "Clamping Set Of Bracket Arms For Supporting Tubular Objects"; and U.S. Design Pat. No. Des. 319,778 patented Sep. 10, 1991 to T. Ziaylek, Jr. on a "Vertical Support Bracket Panel For Holding Tubular Objects"; and U.S. Design Pat. No. Des. 342,666 patented Dec. 28, 1993 to R. G. DePack on a "Scuba Cylinder Attachment Block"; and U.S. Design Pat. No. Des. 347,735 patented Jun. 14, 1994 to T. Ziaylek, Jr. et al on a "Quick Release Support Tank Bracket"; and U.S. Design Pat. No. Des. 394,381 patented May 19, 1998 to T. Ziaylek, Jr. et al on a "Tank Bracket"; and U.S. Design Pat. No. Des. 419,317 patented Jan. 25, 2000 to G. M. Pond et al and assigned to Seats, Inc. on a "Seat"; and U.S. Design Pat. No. Des. 424,414 patented May 9, 2000 to M. P. Ziaylek, et al and assigned to Michael P. Ziaylek, Theodore Ziaylek, Jr. and Theodore P. Ziaylek on an "Adjustable Mountinb Bracket For A Cylindrical Member"; and U.S. Design Pat. No. D480,294 patented Oct. 7, 2003 to T. Ziaylek, Jr. et al on a "Releasable Tank Holding Assembly"; and U.S. Design Pat. No. D494,049 patented Aug. 101, 2004 to M. P. Ziaylek, et al on a "Mounting Bracket With Ejection Mechanism For Holding A Cylindrical Tank"; and U.S. Design Pat. No. D494,453 patented Aug. 17, 2004 to M. P. Ziaylek et al on a "Mechanical Locking Bracket For Holding Cylinders"; and U.S. Design Pat. No. D510,015 patented Sep. 27, 2005 to P. E. Hostetler on a "Portable Holder For Gas Cylinders"; and U.S. Pat. No. 1,911,781 patented May 30, 1933 to O. P. Wolfe, Jr. on a "Support And Holder For Brooms, Mops, And The Like"; and U.S. Pat. No. 2,168,136 patented Aug. 1, 1939 to A. F. Playfair et al and assigned to George W. F. Brisbin and Annie F. Playfair on a "Fire Extinguishing Bomb And Bracket Therefor"; and U.S. Pat. No. 2,431,698 patented Dec. 2, 1947 to H. Lombard on a "Removable Mounting Installation"; and U.S. Pat. No. 2,903,225 patented Sep. 8, 1959 to B. I. Weinstein and assigned to Lockheed Aircraft Corporation on a "Holder For Drinking Cups And The Like"; and U.S. Pat. No. 3,193,232 patented Jul. 6, 1965 to C. M. Hatcher on a "Radio Bracket Or Holder"; and U.S. Pat. No. 3,224,720 patented Dec. 21, 1965 to C. L. Hain and assigned to The Fire Guard Corporation on a "Combined Handle Lock And Bracket For Fire Extinguishers"; and U.S. Pat. No. 3,317,171 patented May 2, 1967 to J. Kramer on a "Cup Or Tumbler Holder For Attachment To Aluminum Chairs Or The Like"; and U.S. Pat. No. 3,547,391 patented Dec. 15, 1970 to D. E. Johnson on a "Quick Release Support For Rescue Breathing Apparatus"; and U.S. Pat. No. 3,565,384 patented Feb. 23, 1971 to L. A. Lockwood and assigned to Bemzomatic Corporation on a "Bracket For Holding And Clamping Gas Cylinder Type Fire Extinguisher Tanks"; and U.S. Pat. No. 3,603,550 patented Sep. 7, 1971 to C. D. Byrd and assigned to Lacy J. Miller Machine Company, Inc. on a "Quick Release Support"; and U.S. Pat. No. 3,737,133 patented Jun. 5, 1973 to A. J. Boecker and assigned to Akron Brass Company on a "Quick-Release Article Holder"; and U.S. Pat. No. 3,780,972 patented Dec. 25, 1973 to J. C. Brodersen on a "Mounting Apparatus For Gas Containers"; and U.S. Pat. No. 3,823,907 patented Jul. 16, 1974 to T. Ziaylek, Jr. on a "Positive Locking Device"; and U.S. Pat. No. 4,213,592 patented Jul. 22, 1980 to D. J. Lingenfeiser and assigned to Caterpillar Tractor Co. on a "Bracket Assembly For Mounting Fire Extinguishers Thereon"; and U.S. Pat. No. 4,379,541 patented Apr. 12, 1983 to D. M. Harkness on a "Holder For A Container"; and U.S. Pat. No. 4,391,377 patented Jul. 5, 1983 to T. Ziaylek, Jr. on a "Knock-Down Assembly For Supporting Oxygen Tanks"; and U.S. Pat. No. 4,586,687 patented May 6, 1986 to T. Ziaylek, Jr. on an "Air Tank Support Of The Quick Release Type"; and U.S. Pat. No. 4,848,714 patented Jul. 18, 1989 to T. Ziaylek, Jr. et al on a "Mounting Plate With Rollers"; and U.S. Pat. No. 4,905,950 patented Mar. 6, 1990 to M. L. Turner et al and assigned to Convenience Marine Products, Inc. on a "Mounting Assembly"; and U.S. Pat. No. 4,971,275 patented Nov. 20, 1990 to J. C. Roberts on a "Lightweight, Flexible Holder For Scuba Tanks And The Like"; and U.S. Pat. No. 4,997,157 patented Mar. 5, 1991 to H. D. Sweeny and assigned to Swenco Limited on a "Multi-Purpose Canister Wall Bracket"; and U.S. Pat. No. 5,071,100 patented to H. D. Sweeny on Dec. 10, 1991 and assigned to Swenco Limited on a "Multi-Purpose canister Wall Bracket"; and U.S. Pat. No. 5,190,260 patented Mar. 2, 1993 to R. P. Daubenspeck on a "Water Heater Tank Support"; and U.S. Pat. No. 5,354,029 patented to T. Ziaylek, Jr. et al on Oct. 11, 1994 on a "Quick Release Tank Support Bracket With Positive Locking Engagement Means"; and U.S. Pat. No. 5,362,022 patented Nov. 8, 1994 to J. E. McLoughlin et al on an "Air Tank Bracket With Strap-Lifting Arms"; and U.S. Pat. No. 5,579,967 patented Dec. 3, 1996 to D. T. Berg on a "Mounting System For Securing Poly Tank To Scuba Main Cylinders"; and U.S. Pat. No. 5,607,133 patented Mar. 4, 1997 to H. L. Markham et al and assigned to E-Z Metal Products, Inc. on an "Apparatus And Method For Supporting A Cylindrical Tank"; and U.S. Pat. No. 5,681,080 patented Oct. 28, 1997 to G. M. Pond et al and assigned to Seats, Inc. on a "Vehicle Seat For Person Wearing Self-Contained Breathing Apparatus"; and U.S. Pat. No. 5,810,089 patented Sep. 22, 1998 to R. J. Mack and assigned to Task Force Tips, Inc. on a "Portable Firefighting Apparatus With Integral Control Valve-Handle"; and U.S. Pat. No. 6,113,004 patented Sep. 5, 2000 to R. W. Steingass et al and assigned to Tank Force Tips, Inc. on a "Portable Kit For Firefighters"; and U.S. Pat. No. 6,220,557 patented Apr. 24, 2001 to M. P. Ziaylek et al and assigned to Michael P. Ziaylek, Theodore Ziaylek, Jr. and Theodore P. Ziaylek on a "Mounting Bracket Means For Detachably Supporting A Generally Cylindrically-Shaped Member Upon A Wall Structure"; and U.S. Pat. No. 6,543,736 patented Apr. 8, 2003 to B. J. Field and assigned to Pacific Safety Products Inc. on a "Quick Release Supporting Apparatus For A Canister"; and U.S. Pat. No. 6,601,923 patented Aug. 5, 2003 to G. Pond et al and assigned to Seats Incorporated on an "Emergency Vehicle Seat With Integrated Seat Belt"; and U.S. Pat. No. 6,685,153 patented Feb. 3, 2004 to M. F. Foreman on a "Restraining System And Method"; and U.S. Pat. No. 6,702,242 patented Mar. 9, 2004 to T. Ziaylek, Jr. et al on a "Releasable Tank Holding Assembly Securable To A Hollow Seat Back To Facilitate Detachable Securement Of A Tank Thereinto"; and U.S. Pat. No. 6,769,659 patented Aug. 3, 2004 to G. A. Martello on a "Bottle Bracket"; and U.S. Pat. No. 6,883,766 patented Apr. 26, 2005 to M. P. Ziaylek et al on a "Quick Release Mechanical Bracket"; and U.S. Pat. No. 6,926,243 patented Aug. 9, 2005 to M. P. Ziaylek et al on a "Mounting Bracket With An Ejection Means For Detachable Retaining Of A Cylindrical Tank Member".

SUMMARY OF THE INVENTION

A mounting bracket apparatus is disclosed in the present invention designed specifically for the purposes of releasably retaining a cylindrical tank with respect to a seatback or planar wall. The mounting bracket includes a backing plate member as well as an upper holder member secured to the backing plate member and extending outwardly therefrom for selectively receiving and holding of the cylindrical tank at a position thereadjacent defined as the tank storage zone. The first upper holder arm and a second upper holder arm will together define this storage zone immediately thereadjacent. A lower holder member is also preferably included secured to the backing plate member at a position below the upper holder member and extending outwardly away from the backing plate for selectively receiving and holding a cylindrical tank. This upper holder member further defines the tank storage zone thereadjacent. The upper holder member includes a lower holder base as well as a first lower holder arm which is secured to the base and extends laterally outward therefrom to a position adjacent the tank storage zone.

Similarly a second lower holder arm is secured to the lower holder base and extends laterally outwardly therefrom into abutment with a cylindrical tank positioned within the tank storage zone to facilitate retaining thereof. This second lower holder arm extends outwardly from the lower holder base and is spatially disposed from the first lower holder arm to facilitate holding of a cylindrical tank therebetween.

The bracket apparatus of the present invention further includes a first securement bracket mounted on the backing plate member extending outward laterally therefrom as well as a second securement bracket mounted on the backing plate member and extending outward laterally therefrom at a position below the first securement bracket. Each of these two brackets preferably extends approximately parallel with respect to one another in a lateral direction away from the backing plate.

An engagement bracket is also included mounted on the backing member and extends laterally outwardly therefrom. This engagement bracket will extend away from the backing plate in a direction different from the first securement bracket and the second securement bracket and in some constructions in an oppositely oriented direction. Preferably the first securement bracket and the second securement bracket and the engagement bracket will each extend outwardly away from the backing plate to a position more distant from the position of the upper holding member and the lower holding member in order to facilitate the obtaining of angular leverage in order to maintain the cylindrical tank within the tank storage zone.

A restraining apparatus is also included movably attached with respect to the first securement bracket and with respect to the second securement bracket and with respect to the engagement bracket. This restraining means is adapted to selectively engage a cylindrical tank for retaining it when positioned in the tank storage zone adjacent the upper holder member and the lower holder member. The restraining mechanism includes a first engagement means attached with respect to the engagement bracket which preferably includes a release line and a release tubing member defining a longitudinal bore to receive the release line extending therethrough to facilitate pulling thereof which effects release of the first engagement means. Also the restraining means includes a second engagement means detachably and selectively engageable with respect to the first engagement mechanism. The release line is specifically operative to disengage the second engagement means from the first engagement means responsive to pulling thereof. That is, operative pulling of the release line is facilitated by positioning thereof extending through the longitudinal bore of the release tubing member.

A first strap is included attached with respect to the first securement bracket and with respect to the second engagement means in such a manner as to be capable of being positioned extending around the cylindrical tank for retaining it in a tank storage zone whenever the first and second engagement means are in the fully engaged position. The strap is also adapted to release the cylindrical tank from the tank storage zone responsive to disengagement of the second engagement device from the first engagement device. This first strap device preferably includes a first length adjustment mechanism positioned adjacent to the first securement bracket for the purpose of selectively and independently adjusting the length of the first strap.

A second strap is also preferably included attached with respect to the second securement bracket and with respect to the second engagement device such as to be positionable extending around a tank when held within the tank storage zone whenever the first and second engagement mechanisms are engaged with one another. This second strap is adapted to release the cylindrical tank from the tank storage zone responsive to disengagement of the second engagement mechanism from the first engagement mechanism. The second strap is adapted to extend around the cylindrical tank when located in the tank storage zone at a position lower than the first strap. The second strap includes a second length adjustment device positioned adjacent to the second securement bracket for the purpose of selectively and independently adjusting the overall length of the second strap. In many prior art devices these adjustment devices were positioned immediately adjacent to the male engagement means which allowed a single adjustable capability that control the length of all straps attached thereto. However, the adjustment mechanism is normally much larger in depth than the straps themselves thus becoming an impediment to rapid release of the straps from the normal mounting position they extend between the self-contained breathing apparatus (SCBA) and the back of a firefighter seated in a fire vehicle with the tank attached to his back while retained by a securement apparatus. The positioning of the adjustment mechanism to a location adjacent the two securement brackets provides for smoother and quicker release of the straps while also allow independent adjustment of the respective lengths thereof.

Most importantly the restraining mechanism includes a webbing panel preferably of triangular shape which is attached longitudinally along a portion of the first strap adjacent the first securement bracket and also is attached longitudinally along a portion of the second strap adjacent the first securement bracket in order to facilitate securing and releasing in a selective manner of the cylindrical tank relative to the tank storage zone. This webbing panel may preferably include a first seam area extending longitudinally therealong which is secured to at least a portion of the first strap to facilitate securing and release of the cylindrical tank from the tank storage zone. The webbing panel will also preferably define a second seam area extending longitudinally therealong which is secured to at least a portion of the second strap to further facilitate securing and releasing of a cylindrical tank from the tank storage zone. The webbing panel is preferably stitched with respect to the first strap and with respect to the second strap to facilitate longitudinal engagement therealong. The first seam area of the webbing panel is sewn to the first strap longitudinally therealong from a position adjacent the second engagement bracket to the first intermediate position. In a similar manner the second seam area of the webbing panel is sewn to the second strap longitudinally therealong from a position adjacent the second engagement bracket to the second intermediate position. The webbing panel is preferably made of a woven polyester material coated with a polyvinyl chloride material. The webbing panel extending between two of the securement straps is preferably positionable between the back of a firefighter seated in a seat in a fire truck and the front of a SCBA tank attached to his back while seated. It allows a smooth and unobstructed release of the straps from the tank whenever a firefighter need to exit the fire vehicle quickly. This webbing panel also prevents entanglements between the cylindrical tank of the breathing apparatus and the securement straps during release.

The bracket apparatus of the present invention may also include a lower shelf member secured to the backing plate member and extending outwardly therefrom to provide support to a cylindrical tank from beneath whenever it is positioned within the tank storage zone.

The first strap may define a first intermediate position thereon intermediate between the second engagement device and the first securement bracket wherein the first seam area of the webbing panel is secured to the first strap longitudinally therealong from a position adjacent to the second engagement bracket to the first intermediate position. In a similar manner the second strap may define a second intermediate position thereon located between the second engagement device and the securement bracket wherein the second seam area of the webbing panel is secured to the second strap longitudinally therealong from a position adjacent the second engagement bracket to the second intermediate position.

In a preferred configuration of the present invention the approximately 30% of the total length of the first and second strap members is secured longitudinally to the first and second seam areas of the webbing panel, respectively.

In a further preferred configuration the first engagement mechanism comprises a female latching member such as a seatbelt receiving means and the second engagement device comprises a male latching member such as a seatbelt tab or tongue device. With this configuration the male latching member is adapted to extend within the female latching member to facilitate detachable engagement between the first engagement device and the second engagement device.

It is an object of the present invention to provide a mounting bracket for detachably holding of a cylindrical tank wherein the tank is maintained in vertical orientation.

It is an object of the present invention to provide a mounting bracket for detachably holding of a cylindrical tank wherein the positive means of affixing of the tank within the tank holding zone is provided.

It is an object of the present invention to provide a mounting bracket for detachably holding of a cylindrical tank wherein unwanted entanglements between the retaining straps and the retained tank apparatus is minimized especially during rapid exit by emergency personnel.

It is an object of the present invention to provide a mounting bracket for detachably holding of a cylindrical tank wherein maintenance costs are minimized.

It is an object of the present invention to provide a mounting bracket for detachably holding of a cylindrical tank wherein initial capital outlay cost is minimized.

It is an object of the present invention to provide a mounting bracket for detachably holding of a cylindrical tank wherein the user can easily operate the release mechanism with one hand without requiring searching for a release cord.

It is an object of the present invention to provide a mounting bracket for detachably holding of a cylindrical tank wherein the number of parts is minimized.

It is an object of the present invention to provide a mounting bracket for detachably holding of a cylindrical tank wherein mounting with respect to a vertically extending wall or an emergency vehicle seat is possible.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
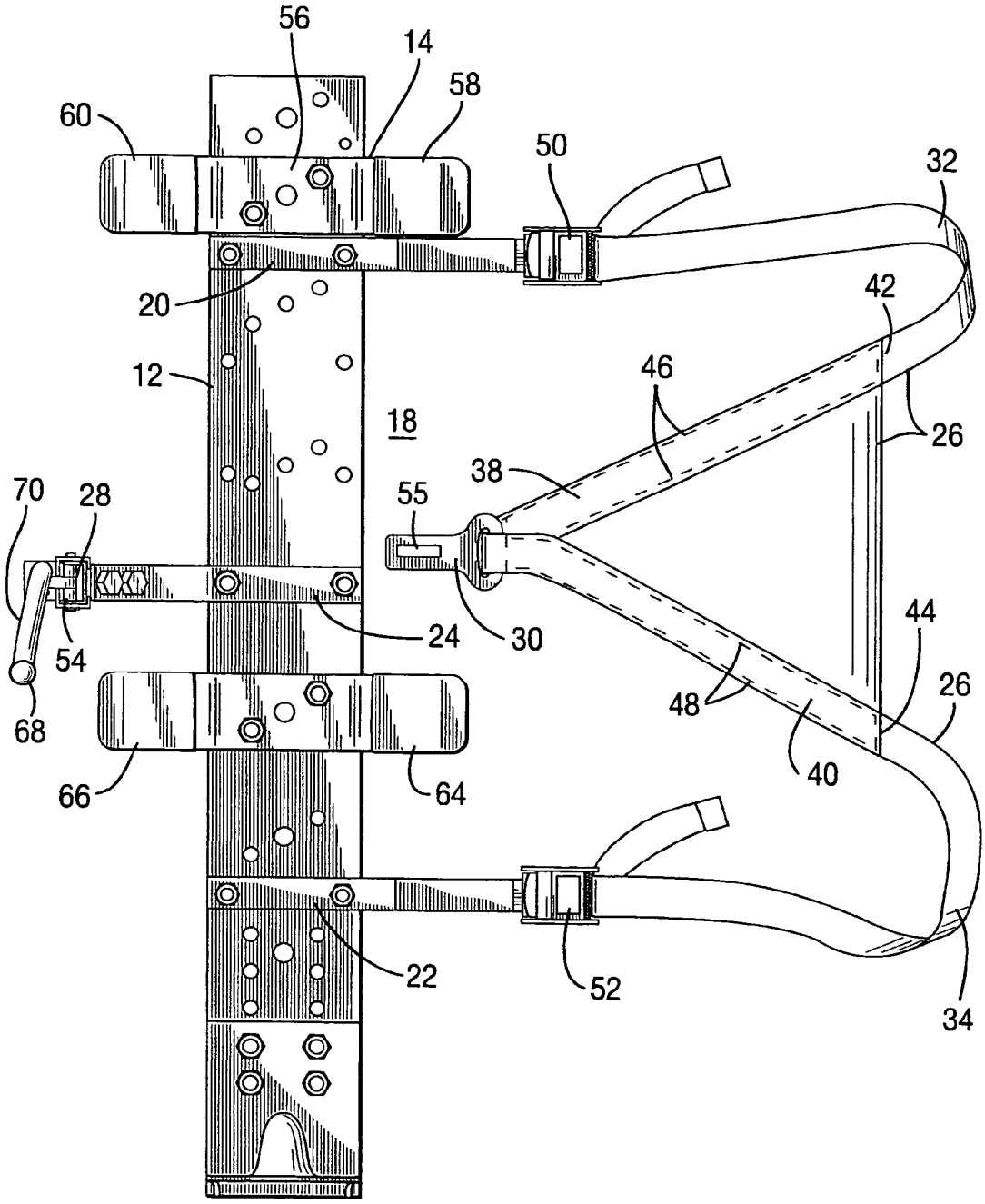
FIG. 1 is a front plan view of an embodiment of the mounting bracket of the present invention usable for detachable holding of a cylindrical tank therein.
Figure 2:
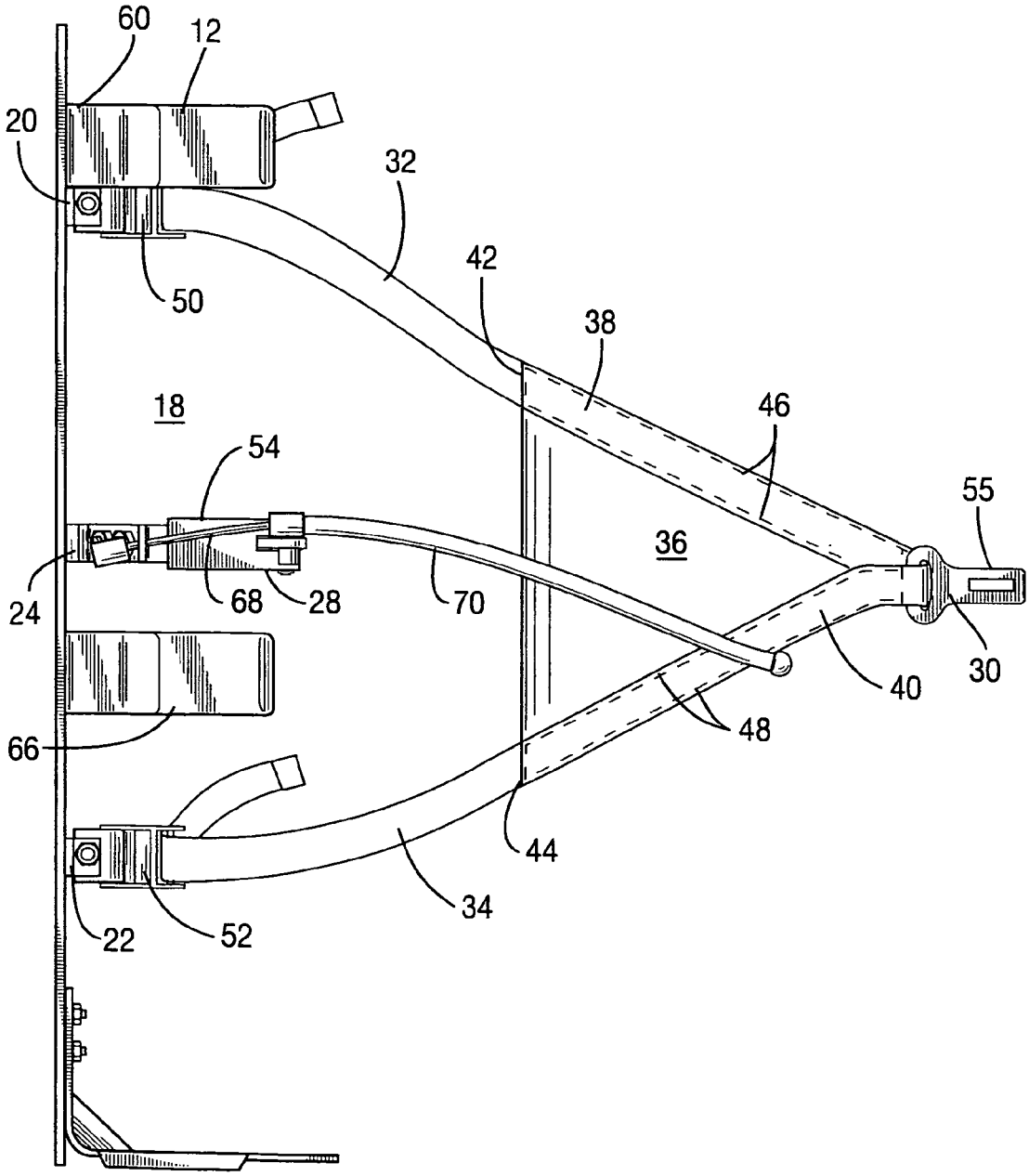
FIG. 2 is a side plan view of the embodiment shown in FIG. 1.
Figure 3:
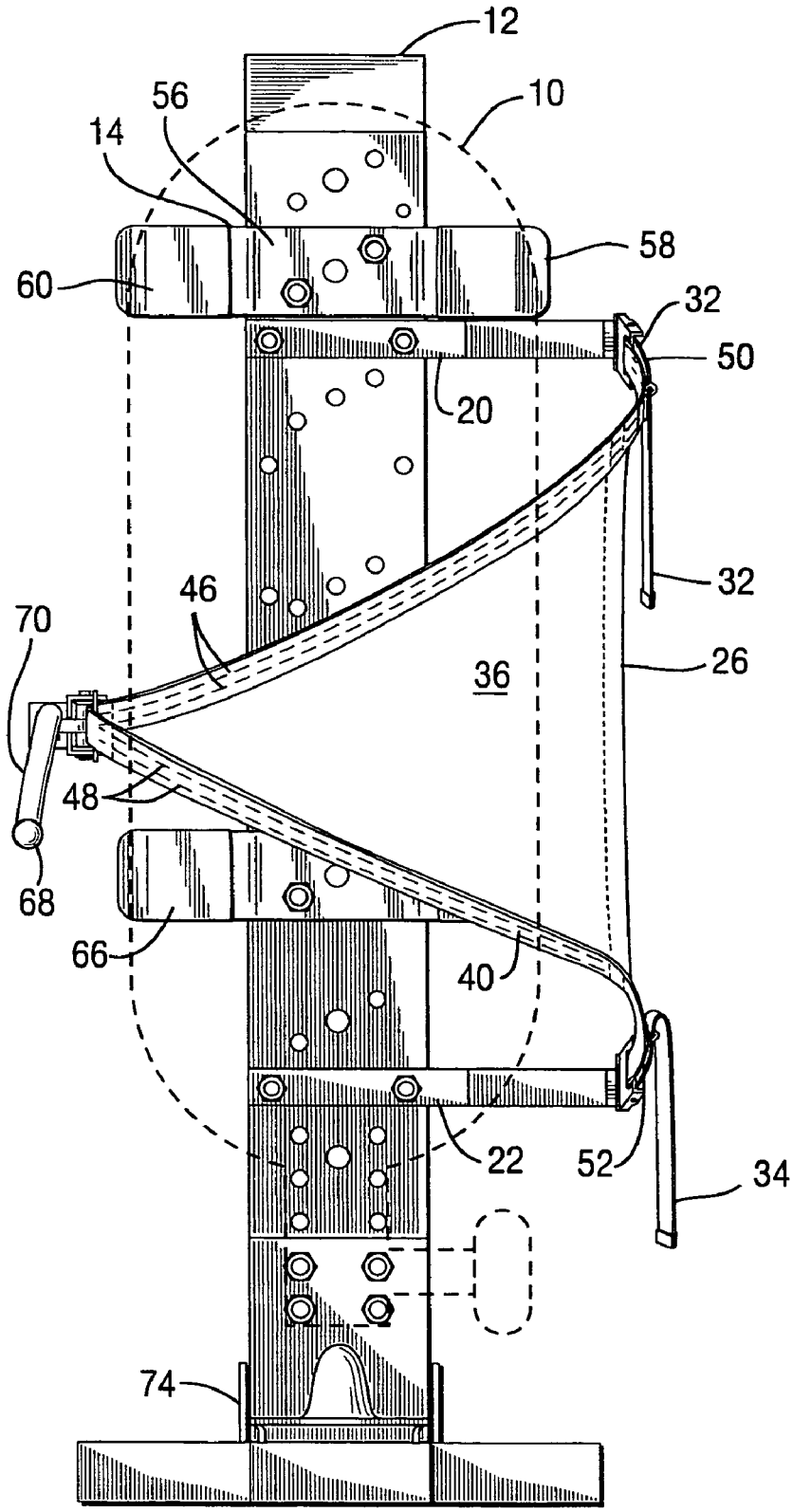
FIG. 3 is a front perspective illustration with the restraining apparatus shown in the engaged or closed position and showing the cylindrical tank in dotted outline.
Figure 4:
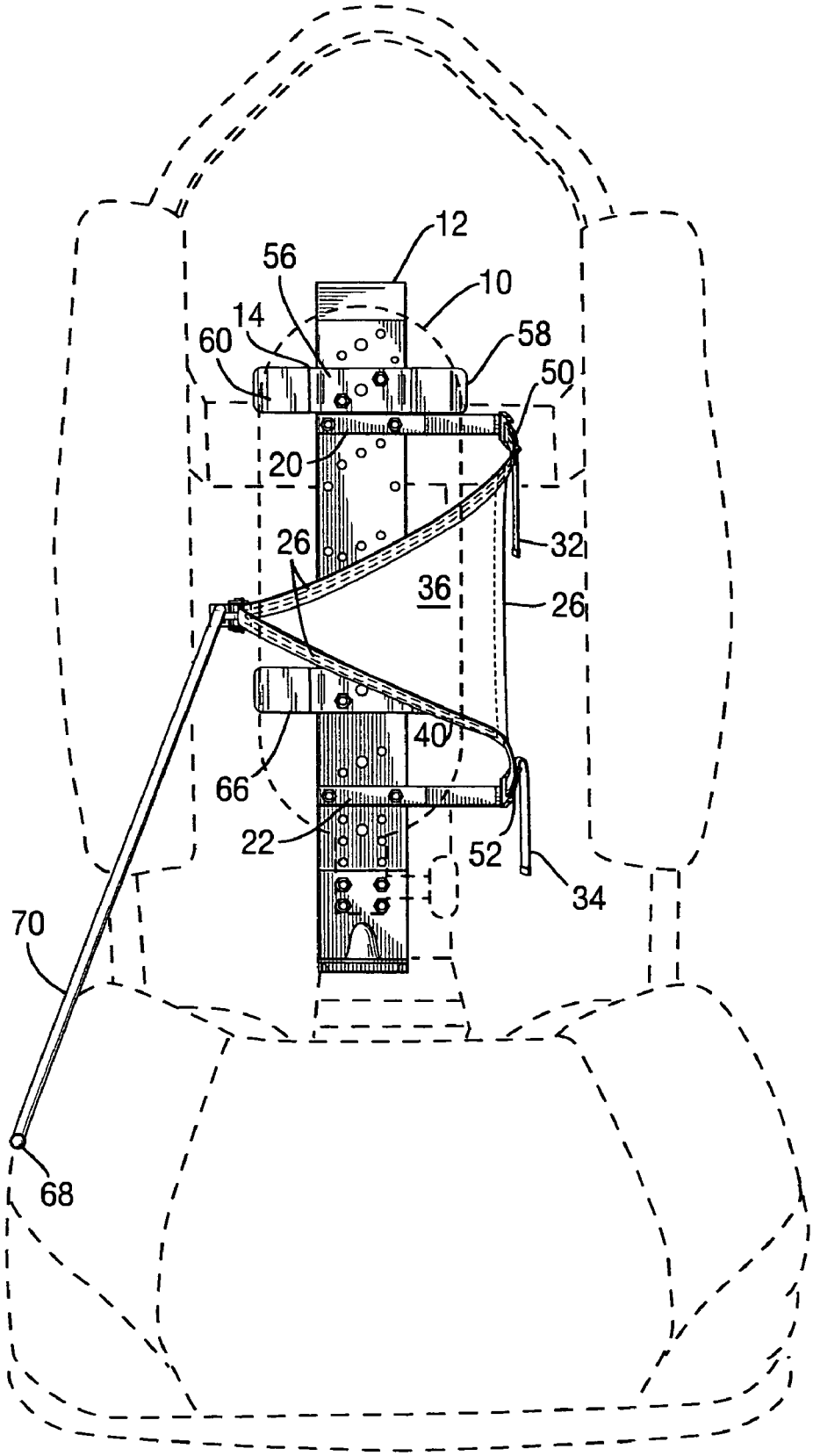
FIG. 4 is a front perspective illustration of the mounting bracket apparatus of the present invention shown in the closed position mounted within a seatback.
Figure 5:
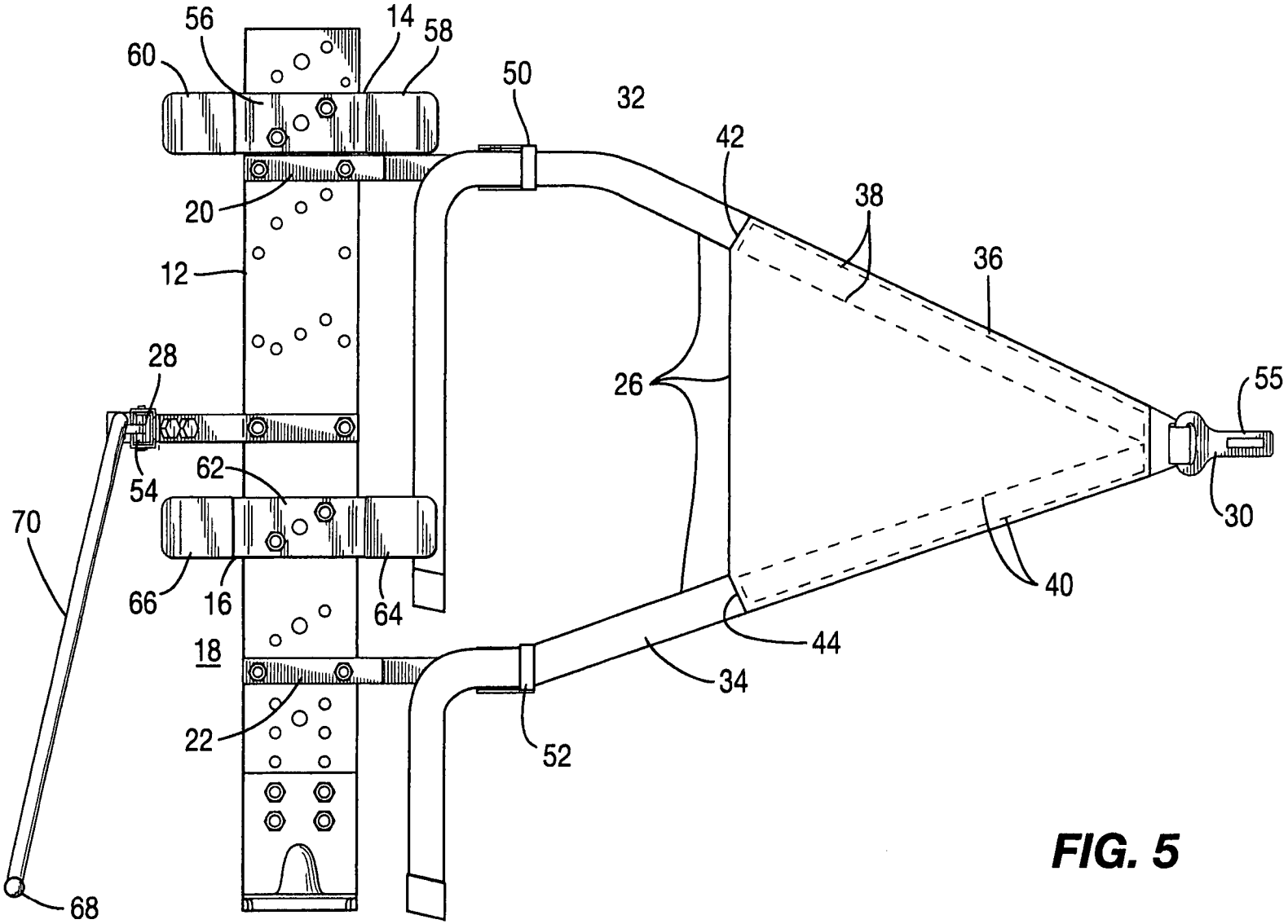
FIG. 5 is a perspective illustration of an embodiment of the mounting bracket apparatus of the present invention shown in the open position.
Figure 6:
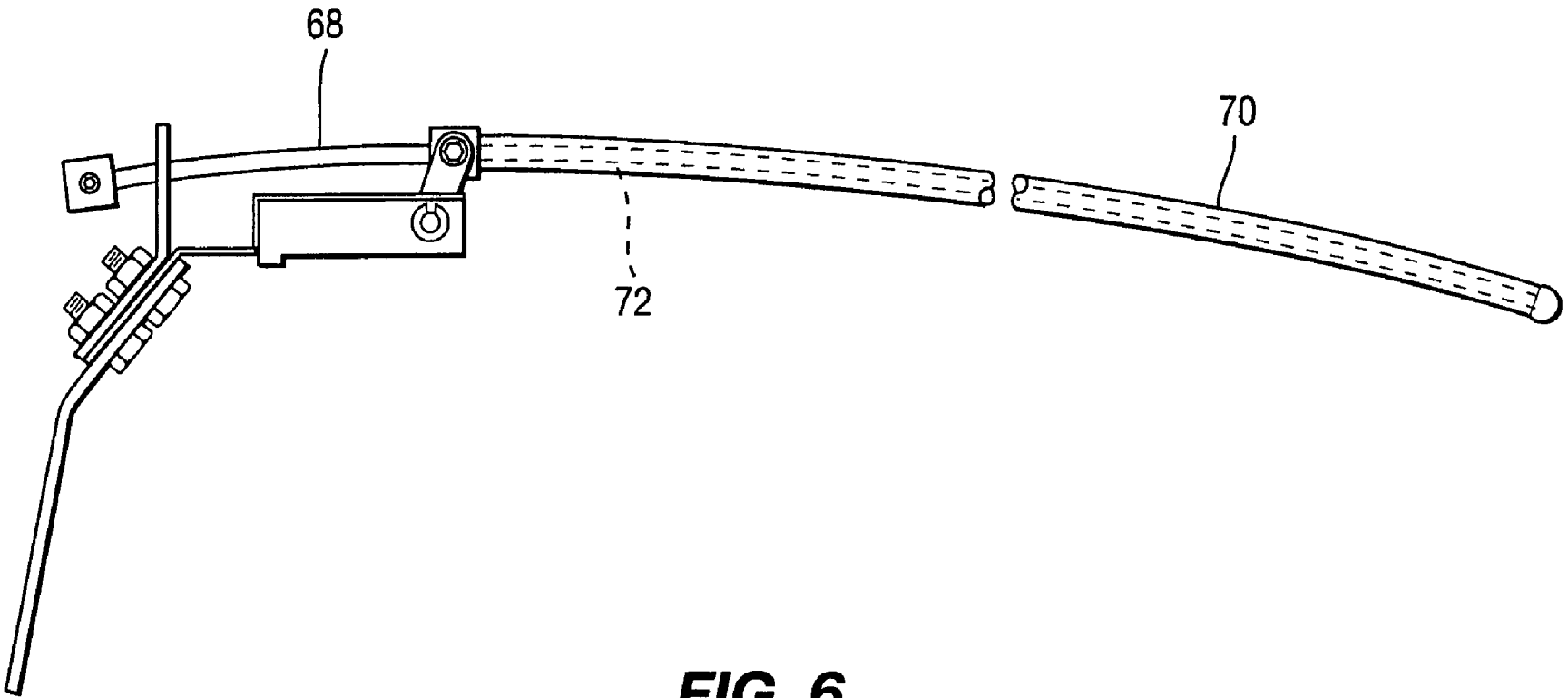
FIG. 6 is an exploded top plan view of the first and second engagement means shown in the engaged position.

As shown in the drawings herein, the present invention provides a unique configuration for a mounting bracket for holding of a cylindrical tank 10 in position and ready for quick removal for immediate use. Such tanks commonly carry air supplies for emergency workers on fire trucks and are mounted on the walls of such fire trucks or fire houses. Also the cylindrical air tanks can be mounted in the back portion of seats within fire trucks as shown best in FIG. 4. In all of these applications it is important that a very secure means of retaining the tank in place, especially during high speed movement of such fire trucks, is desired. It is also necessary to instantaneously disengage the tanks from the mounting locations such that emergency personnel can be rapidly deployed.

The preferred configuration for the bracket of the present invention includes a backing plate member 12 which includes an upper holder member generally described as 14 and a lower holder member defined as 16. The upper holder member 14 preferably includes an upper holder base 56 with a first upper holder arm 58 extending in one direction and a second upper holder arm 60 extending in a different direction. The area between the first upper holder arm 58 and the second upper holder aim 60 will define the tank storage zone 18 thereadjacent in which a cylindrical tank 10 is designed to be placed and selectively detachably secured.

A similar configuration is provided for the lower holding member 16 which is positioned secured to the backing plate member 12 at a position below the upper holding member 14. This lower holding member 16 will include a lower holder base means 62 secured directly to the backing plate member 12 as well as a first lower holder arm means 64 and a second lower holder arm means 66 extending outwardly away from the lower holder base 62 at positioned spaced apart in order to facilitate defining an additional portion of the tank storage zone 18. Preferably the first upper holder arm means 58 and the second upper holder arm means 60 will be angularly positioned with respect to one another to receive various sizes of cylindrical tanks 10. A similar angular relationship will is desirable between the first lower holder arm 64 and the second lower holder am 66 in order to facilitate defining of a tank storage zone 18 which can accommodate cylindrical tanks 10 of various sizes.

It is important that a means be provided for securing the cylindrical tank 10 in the tank storage zone 18 and such a device is defined within the present invention as the restraining means 26. The restraining means 26 is operable with a series of brackets secured to the backing plate member 12 in order to detachably affix a tank 10 in the zone 18.

A first securement bracket 20 is preferably fixedly secured to the backing plate member 12 and extends outward laterally therefrom. A second securement bracket 22 will also be secured to the backing plate member 12 and extend outwardly therefrom in a direction generally similar to the direction that the first securement bracket 20 is oriented. An engagement bracket 24 will preferably extend in a direction somewhat spatially disposed from the first securement bracket 20 and the second securement bracket 22 in order to facilitate defining therebetween the tank storage zone 18 for receiving of the cylindrical tank 10.

The restraining means 26 is secured movably with respect to the first securement bracket 20 and with respect to the second securement bracket 22 and with respect to the engagement bracket 24.

In particular, the restraining device 26 includes a first strap means 32 movably secured to the first securement bracket 20 and a second strap 34 detachably secured with respect to the second securement bracket 22. Preferably the second securement bracket 22 and the second strap 34 will be positioned somewhat beneath the first securement bracket 20 and the first strap 32 to facilitate selective retaining of a cylindrical tank 10 within the tank storage zone 18.

The first strap means 32 and the second strap means 34 will both extend from their respective securement brackets 20 and 22 to a second engagement means 30. This second engagement means 30 preferably comprises a tab or male engagement member. A first engagement means 28 which is engageable with respect to the second engagement means 30 will preferably be in the form of a buckle-type device. This first engagement means 28 will be secured with respect to the engagement bracket 24.

Therefore, as the first strap 32 extends from the first securement bracket 20 and the second strap 34 extends from the second securement bracket 22, they will both wrap around a cylindrical tank 10 when positioned within the tank storage zone 18. This securement will be firm because the first strap 32 is positioned significantly higher than the second strap 34. However, the two parts do come to a common point where they both are attached to the second engagement means 30 which is a tab or the like. In some configurations the first and second strap means 32 and 34 can actually be a single piece of strap material which defines the first strap 32 as it extends from the first securement bracket 20 to the second engagement means 30 and then extends perhaps through the tab 30 back across the lower portion of the cylindrical tank and thereby providing the second strap 34 which is then secured to the second securement bracket 22.

An important aspect of the present invention is the inclusion of a webbing panel 36 which is secured to the first strap 32 and to the second strap 34 and extends therebetween. This webbing panel 36 will be a planar member preferably of a woven polyester base which is coated with a polyvinyl chloride type material. Preferably the webbing panel 36 is of a triangular shape and defines a first seam area 38 along one edge thereof and a second seam area 40 along another edge thereof. The first seam area 38 is attachable to the first strap 32 along a portion thereof in an area immediately adjacent to the second engagement means 30. In a similar manner the second seam area 40 of the webbing panel 36 is attachable to the second strap 34 along a portion thereof immediately adjacent to the second engagement means 30.

The first strap 32 will define a first intermediate position 42 at a location between the second engagement means 30 and the first securement bracket 20 which is defined as the first intermediate position. A second intermediate position 44 will be defined on the second strap 34 at a position between the second engagement device 30 and the second securement bracket 22. The first seam area 38 of the webbing panel 36 will preferably be secured to the first strap 32 in the area between the second engagement tab 30 and the first intermediate position 42. In a similar manner the second seam area 40 of the webbing panel 36 will preferably be secured to the second strap 34 along an area thereof extending between the second engagement means 30 and the second intermediate position 44. This webbing is a significant enhancement of the prior art because it tends to prevent entanglements of the first and second straps 32 and 34 during quick removal of the tank 10 from the zone 18 usually when strapped on the back of a fireman or other emergency as they move away from a wall or seat area where the bracket of the present invention is mounted.

The planar webbing panel 36 tends to carry the first and second straps 32 and 34 above various protruding parts, configurations and other members on the tank 10 or of the associated tank apparatus secured thereto. In prior art devices the first and second straps 32 and 34 would tend to catch or become tangled or snagged on any protruding portion of the tank or the tank holding apparatus which would prevent the emergency worker from making a rapid exit from the emergency vehicle or the firehouse. This panel, because of its planar configuration and that fact that it is firmly secured along a portion of the first and second straps 32 and 34, will carry those two straps above any protruding members and in that manner prevent entanglements. Also this panel 36 will normally be positioned between an SCBA tank and the back of a firefighter when seated in a fire truck where the tank is positioned within an opening in the seatback of the truck seat. The panel is great facilitate the smooth and quick sliding of the straps and the panel itself laterally across the back of the firefighter and across the front of the breathing air tank strapped to his body.

Another significant benefit of the inclusion of the webbing panel 36 is that the tacky material from which it is made tends to enhance the gripping of the outer peripheral circumference area of the cylindrical tank 10 to facilitate holding thereof within the tank storage zone 18. Also, this webbing panel 36 maintains the desired spacing between the first and second straps 32 and 34 as they wrap around the outer periphery of the cylindrical tank 10 which further facilitates a leveraged retaining of such tanks within the tank storage zone 18 immediately adjacent to the bracket of the present invention.

Securement between the first and second seams 38 and 40 of the webbing panel 36 relative to the first and second straps 32 and 34 is an important consideration. For this reason normally the seams will be stitched or otherwise sewn to the respective strap. That is, the first seam area 38 will be stitched to the first strap 32 by first stitching 46 to make a firm engagement therebetween. Similarly, second stitching 48 will be utilized penetrating the second strap 34 to engage it with respect to the second seam area 40 to maintain a first securement therebetween. The use of such stitching maintains an intimate bond between two seam areas and the two strap sections.

To further facilitate adaptability of the present invention with regard to various configurations of cylindrical tanks 10, a first length adjustment means 50 may be included with the first strap 32 in the area thereof immediately adjacent to the first securement bracket 20. This adjustability is operative to vary the overall length of the first strap 32 as desired. In a similar manner a second length adjustment means 52 can be included in the second strap 34 preferably at a position immediately adjacent to the second securement bracket 22. This second adjustment means 52 is operative to vary the overall total length of the second strap 34. By careful adjustment of the first length adjustment means 50 and the second length adjustment means 52 various different sizes and configurations of cylindrical tanks can be utilized positioned within the tank storage zone 18.

In most prior art devices adjustment mechanisms were positioned immediately adjacent to the male engagement means which allowed for a single adjustable capability that control the length of all straps attached thereto. However, the prior art adjustment mechanism are normally much greater in overall depth than the straps themselves thus becoming an impediment to rapid release of the straps from the normal mounting position when they extend between the self contained breathing apparatus (SCBA) and the back of a firefighter seated in a fire vehicle with the tank attached to his back while retained by a securement apparatus. The positioning of the adjustment mechanism to a location adjacent the two securement brackets provides for smoother and quicker release of the straps while also allow independent adjustment of the respective lengths thereof.

In a preferred configuration of the present invention the first engagement means 28 comprises a buckle or similar female latching member 54 whereas the second engagement means 30 preferably will comprise a tab or other similar male latching member 55. Engagement of the male latching member or tab 55 with respect to the female latching member 54 configured perhaps as a buckle will provide a firm means for securing of the restraining means 26 around a cylindrical tank 12 while at the same time allowing for easy and rapid disengagement thereof.

Disengagement of the second engagement means 30 from the first engagement means 28 is provided by the inclusion of a release line 68 in the configuration of the first engagement means 28. This release line is operative to be pulled to release the male latching member 55 from the female latching member 54 for disengagement of the second engagement means or tab 30 from the first engagement means or buckle 28. This release line 68 is sometimes difficult to locate and therefore a tubing member 70 of a somewhat rigid material is preferably included which defines a longitudinal bore 72 which is adapted to receive the release line 68 extending therethrough. With the release line 68 firmly in position extending through the longitudinal bore 72 and secured with respect to the tubing member 70, the release line will extend outwardly in a generally horizontal direction which greatly facilitates locating it by emergency personnel when instantaneous disengagement of the cylindrical tank 10 from the tank storage zone 18 is desired.

The present invention can also provide significant additional support for the cylindrical tank 10 when positioned in the tank storage zone 18 by the inclusion of a lower shelf member 74 adapted to be positioned beneath the cylindrical tank 10. This lower shelf member 74 can support the cylindrical tank from beneath and in this manner facilitate support thereof when held in the tank storage zone 18.

It is important in the present invention to appreciate that the positioning of the first and second securement brackets 22 and the engagement bracket 24 is an important aspect of the present invention. It is preferable that these brackets extend outwardly away from the backing plate member 12 to a distance significantly greater than the configuration of the upper holding member 14 and the lower holding member 16. Since the first engagement means 28 will be attached with respect to the engagement bracket 24 and since the first and second strap means 32 and 34 will be attached with respect to the first and second securement brackets 20 and 22, additional leverage is provided by establishing these securement positions at a wider footprint adjacent to the mounting planar surface or seat of the vehicle. Also entanglements with the straps are further minimized by positioning the engagement means and the two strap mounting locations on a wider footprint.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A mounting bracket for detachable holding of a cylindrical tank comprising:

A. a backing plate member;

B. an upper holding member secured to said backing plate member and extending outwardly away therefrom for selectively receiving and holding a cylindrical tank thereadjacent;

C. a lower holding member secured to said backing plate member at a position below said upper holding member and extending outwardly away therefrom for selectively receiving and holding a cylindrical tank thereadjacent, said upper holding member and said lower holding member together defining a tank storage zone thereadjacent for facilitating selective receiving and retaining of a cylindrical tank therewithin;

D. a first securement bracket means mounted on said backing plate member and extending outwardly laterally therefrom;

E. a second securement bracket means mounted on said backing plate member and extending outwardly laterally therefrom, said second securement bracket means being mounted on said backing plate member at a position below said first securement bracket means;

F. an engagement bracket means mounted on said backing plate member and extending outwardly laterally therefrom;

G. a restraining means attached with respect to said first securement bracket means, said second securement bracket means and said engagement bracket means and being adapted to selectively engage a cylindrical tank for retaining thereof within said tank storage zone adjacent said upper holding member and said lower holding member, said restraining means comprising:

(1) a first engagement means attached with respect to said engagement bracket means;

(2) a second engagement means detachably and selectively engageable with respect to said first engagement means;

(3) a first strap means attached with respect to said first securement bracket means and with respect to said second engagement means and being positionable extending around a cylindrical tank for holding thereof within said tank storage zone responsive to engagement of said first engagement means with respect to said second engagement means, said first strap means being adapted to release the cylindrical tank from said tank storage zone responsive to disengagement of said second engagement means from said first engagement means;

(4) a second strap means attached with respect to said second securement bracket means and with respect to said second engagement means and being positionable extending around a cylindrical tank for holding thereof within said tank storage zone responsive to engagement of said first engagement means with respect to said second engagement means, said second strap means being adapted to release the cylindrical tank from said tank storage zone responsive to disengagement of said second engagement means from said first engagement means, said second strap means adapted to extend around a cylindrical tank within said tank storage zone at a position below said first strap means; and (5) a webbing panel means attached longitudinally along a portion of said first strap means adjacent said first securement bracket means and also being attached longitudinally along a portion of said second strap means adjacent said first securement bracket means to facilitate securing and releasing of a cylindrical tank from said tank storage zone.

2. A mounting bracket for detachable holding of a cylindrical tank as defined in claim 1 wherein said webbing panel means defines a first seam area extending longitudinally therealong which is secured to at least a portion of said first strap means to facilitate securing and releasing of a cylindrical tank from said tank storage zone, and wherein said webbing panel means further defines a second seam area extending longitudinally therealong which is secured to at least a portion of said second strap means to also facilitate securing and releasing of a cylindrical tank from said tank storage zone.

3. A mounting bracket for detachable holding of a cylindrical tank as defined in claim 2 wherein said first strap means defines a first intermediate position thereon located intermediate between said second engagement means and said first securement bracket means and wherein said first seam area of said webbing panel means is secured to said first strap means longitudinally therealong from a position adjacent said second engagement bracket means to said first intermediate position, and wherein said second strap means defines a second intermediate position thereon located intermediate between said second engagement means and said second securement bracket means and wherein said second seam area of said webbing panel means is secured to said second strap means longitudinally therealong from a position adjacent said second engagement bracket means to said second intermediate position.

4. A mounting bracket for detachable holding of a cylindrical tank as defined in claim 1 wherein said webbing panel means is stitched with respect to said first strap means and with respect to said second strap means to facilitate longitudinal engagement with respect thereto.

5. A mounting bracket for detachable holding of a cylindrical tank as defined in claim 3 wherein said first seam area of said webbing panel means is sewn to said first strap means longitudinally therealong from a position adjacent said second engagement bracket means to said first intermediate position, and wherein said second seam area of said webbing panel means is sewn to said second strap means longitudinally therealong from a position adjacent said second engagement bracket means to said second intermediate position.

6. A mounting bracket for detachable holding of a cylindrical tank as defined in claim 1 wherein said webbing panel means is made of a thermoplastic resin material.

7. A mounting bracket for detachable holding of a cylindrical tank as defined in claim 1 wherein said webbing panel comprises a woven polyester base material which is coated with a polyvinyl chloride material.

8. A mounting bracket for detachable holding of a cylindrical tank as defined in claim 1 wherein said webbing panel means is triangular in shape.

9. A mounting bracket for detachable holding of a cylindrical tank as defined in claim 1 wherein said first securement bracket means and said second securement bracket means extend approximately parallel with respect to one another in a lateral direction away from said backing plate member and wherein said engagement bracket means extends laterally away from said back plate member in a direction oppositely oriented from said first securement bracket means and said second securement bracket mean.

10. A mounting bracket for detachable holding of a cylindrical tank as defined in claim 1 wherein said first strap means includes a first length adjustment means positioned adjacent said first securement bracket means for selectively and independently adjusting the length of said first strap means and wherein said second strap means includes a second length adjustment means positioned adjacent said second securement bracket means for selectively and independently adjusting the length of said second strap means.

11. A mounting bracket for detachable holding of a cylindrical tank as defined in claim 2 wherein said first seam area of said webbing panel means is secured to approximately 30% of the total length of said first strap means at a position adjacent said second engagement means.

12. A mounting bracket for detachable holding of a cylindrical tank as defined in claim 1 wherein said first engagement means includes a female latching member and said second engagement means includes a male latching member wherein said male latching member is adapted to extend within said female latching member to facilitate detachably engagement between said first engagement means and said second engagement means.

13. A mounting bracket for detachable holding of a cylindrical tank as defined in claim 1 wherein said upper holding member includes:

A. an upper holder base means;

B. a first upper holder arm means secured to said upper holder base means and extending laterally outwardly therefrom into abutment with a cylindrical tank positioned within said tank storage zone for facilitating holding thereof;

C. a second upper holder arm means secured to said upper holder base means and extending laterally outwardly therefrom into abutment with a cylindrical tank positioned within said tank storage zone for facilitating holding thereof, said second upper holder arm means extending outwardly from said upper holder base means and being spatially disposed from said first upper holder aim means to facilitate holding of a cylindrical tank positioned within said tank storage, said first upper holder arm means and said second upper holder arm means defining said tank storage zone therebetween to receive and hold a cylindrically shaped tank member therewithin.

14. A mounting bracket for detachable holding of a cylindrical tank as defined in claim 13 wherein said lower holding member includes:

A. a lower holder base means;

B. a first lower holder aim means secured to said lower holder base means and extending laterally outwardly therefrom into abutment with a cylindrical tank positioned within said tank storage zone for facilitating holding thereof;

C. a second lower holder arm means secured to said lower holder base means and extending laterally outwardly therefrom into abutment with a cylindrical tank positioned within said tank storage zone for facilitating holding thereof, said second lower holder arm means extending outwardly from said lower holder base means and being spatially disposed from said first lower holder arm means to facilitate holding of a cylindrical tank positioned within said tank storage, said first lower holder arm means and said second lower holder arm means defining said tank storage zone therebetween to receive and hold a cylindrically shaped tank member therewithin.

15. A mounting bracket for detachable holding of a cylindrical tank as defined in claim 1 wherein said first securement bracket means, said second securement bracket means and said engagement bracket means extend outwardly away from said backing plate member to a position more distant therefrom than the position of said upper holding member and said lower holding member to facilitate holding of a cylindrical tank within said tank storage zone.

16. A mounting bracket for detachable holding of a cylindrical tank as defined in claim 1 wherein said first engagement means includes a release line operative to disengage said second engagement means from said first engagement means responsive to pulling thereof.

17. A mounting bracket for detachable holding of a cylindrical tank as defined in claim 16 wherein said first engagement means further comprising a release tubing member defining a longitudinal bore means extending therethrough which is adapted to receive said release line positioned extending therethrough to facilitate control of operative pulling thereof.

18. A mounting bracket for detachable holding of a cylindrical tank as defined in claim 17 wherein said release tubing member is made of a rigid material to facilitate locating and grasping thereof to facilitate operative pulling of said release line to disengage said second engagement means from said first engagement means responsive to pulling thereof.

19. A mounting bracket for detachable holding of a cylindrical tank as defined in claim 1 further comprising a lower shelf member secured to said backing plate member and extending outwardly therefrom to provide support to a cylindrical tank from beneath thereof responsive to being positioned within said tank storage zone.

20. A mounting bracket for detachable holding of a cylindrical tank as defined in claim 1 wherein said first strap means and said second strap means are integrally with respect to one another to be defined by a single piece of strap material extending through said second engagement means.

21. A mounting bracket for detachable holding of a cylindrical tank comprising:

A. a backing plate member;

B. an upper holding member secured to said backing plate member and extending outwardly away therefrom for selectively receiving and holding a cylindrical tank thereadjacent;

C. a lower holding member secured to said backing plate member at a position below said upper holding member and extending outwardly away therefrom for selectively receiving and holding a cylindrical tank thereadjacent, said upper holding member and said lower holding member together defining a tank storage zone thereadjacent for facilitating selective receiving and retaining of a cylindrical tank therewithin;

D. a first securement bracket means mounted on said backing plate member and extending outwardly laterally therefrom;

E. a second securement bracket means mounted on said backing plate member and extending outwardly laterally therefrom, said second securement bracket means being mounted on said backing plate member at a position below said first securement bracket means;

F. an engagement bracket means mounted on said backing plate member and extending outwardly laterally therefrom;

G. a restraining means movably attached with respect to said first securement bracket means, said second securement bracket means and said engagement bracket means and being adapted to selectively engage a cylindrical tank for retaining thereof within said tank storage zone adjacent said upper holding member and said lower holding member, said restraining means comprising:

(1) a first engagement means attached with respect to said engagement bracket means, said first engagement means including a release line, said first engagement means further comprising a release tubing member defining a longitudinal bore means extending therethrough adapted to receive said release line extending therethrough;

(2) a second engagement means detachably and selectively engageable with respect to said first engagement means, said release line being operative to disengage said second engagement means from said first engagement means responsive to pulling thereof, operative pulling of said release line being facilitated by positioning thereof extending through said longitudinal bore means of said release tubing member;

(3) a first strap means attached with respect to said first securement bracket means and with respect to said second engagement means and being positionable extending around a cylindrical tank for holding thereof within said tank storage zone responsive to engagement of said first engagement means with respect to said second engagement means, said first strap means being adapted to release the cylindrical tank from said tank storage zone responsive to disengagement of said second engagement means from said first engagement means, said first strap means including a first length adjustment means positioned adjacent said first securement bracket means for selectively and independently adjusting the length of said first strap means;

(4) a second strap means attached with respect to said second securement bracket means and with respect to said second engagement means and being positionable extending around a cylindrical tank for holding thereof within said tank storage zone responsive to engagement of said first engagement means with respect to said second engagement means, said second strap means being adapted to release the cylindrical tank from said tank storage zone responsive to disengagement of said second engagement means from said first engagement means, said second strap means adapted to extend around a cylindrical tank within said tank storage zone at a position below said first strap means, said second strap means including a second length adjustment means positioned adjacent said second securement bracket means for selectively and independently adjusting the length of said second strap means; and (5) a webbing panel means of triangular shape which is attached longitudinally along a portion of said first strap means adjacent said first securement bracket means and also being attached longitudinally along a portion of said second strap means adjacent said first securement bracket means to facilitate securing and releasing of a cylindrical tank from said tank storage zone, said webbing panel means defining a first seam area extending longitudinally therealong which is secured to at least a portion of said first strap means to facilitate securing and releasing of a cylindrical tank from said tank storage zone, and wherein said webbing panel means further defines a second seam area extending longitudinally therealong which is secured to at least a portion of said second strap means to also facilitate securing and releasing of a cylindrical tank from said tank storage zone.

22. A mounting bracket for detachable holding of a cylindrical tank comprising:

A. a backing plate member;

B. an upper holding member secured to said backing plate member and extending outwardly away therefrom for selectively receiving and holding a cylindrical tank thereadjacent, said upper holding member including:

(1) an upper holder base means;

(2) a first upper holder arm means secured to said upper holder base means and extending laterally outwardly therefrom into abutment with a cylindrical tank positioned within said tank storage zone for facilitating holding thereof;

(3) a second upper holder arm means secured to said upper holder base means and extending laterally outwardly therefrom into abutment with a cylindrical tank positioned within said tank storage zone for facilitating holding thereof, said second upper holder arm means extending outwardly from said upper holder base means and being spatially disposed from said first upper holder arm means to facilitate holding of a cylindrical tank positioned within said tank storage zone, said first upper holder arm means and said second upper holder arm means defining said tank storage zone therebetween to receive and hold a cylindrically shaped tank member therewithin;

C. a lower holding member secured to said backing plate member at a position below said upper holding member and extending outwardly away therefrom for selectively receiving and holding a cylindrical tank thereadjacent, said upper holding member and said lower holding member together defining a tank storage zone thereadjacent for facilitating selective receiving and retaining of a cylindrical tank therewithin, said lower holding member including:

(1) a lower holder base means;

(2) a first lower holder arm means secured to said lower holder base means and extending laterally outwardly therefrom into abutment with a cylindrical tank positioned within said tank storage zone for facilitating holding thereof;

(3) a second lower holder arm means secured to said lower holder base means and extending laterally outwardly therefrom into abutment with a cylindrical tank positioned within said tank storage zone for facilitating holding thereof, said second lower holder arm means extending outwardly from said lower holder base means and being spatially disposed from said first lower holder arm means to facilitate holding of a cylindrical tank positioned within said tank storage, said first lower holder arm means and said second lower holder arm means defining said tank storage zone therebetween to receive and hold a cylindrically shaped tank member therewithin;

D. a first securement bracket means mounted on said backing plate member and extending outwardly laterally therefrom;

E. a second securement bracket means mounted on said backing plate member and extending outwardly laterally therefrom, said second securement bracket means being mounted on said backing plate member at a position below said first securement bracket means, said first securement bracket means and said second securement bracket means extending approximately parallel with respect to one another in a lateral direction away from said backing plate member;

F. an engagement bracket means mounted on said backing plate member and extending outwardly laterally therefrom, said engagement bracket means extending laterally away from said back plate member in a direction oppositely oriented from said first securement bracket means and said second securement bracket mean, said first securement bracket means and said second securement bracket means and said engagement bracket means extending outwardly away from said backing plate member to a position more distant therefrom than the position of said upper holding member and said lower holding member to facilitate holding of a cylindrical tank within said tank storage zone;

G. a restraining means movably attached with respect to said first securement bracket means, said second securement bracket means and said engagement bracket means and being adapted to selectively engage a cylindrical tank for retaining thereof within said tank storage zone adjacent said upper holding member and said lower holding member, said restraining means comprising:

(1) a first engagement means attached with respect to said engagement bracket means, said first engagement means including a release line, said first engagement means further comprising a release tubing member defining a longitudinal bore means extending therethrough adapted to receive said release line extending therethrough, said release tubing member being made of a rigid material to facilitate operative pulling of said release line;

(2) a second engagement means detachably and selectively engageable with respect to said first engagement means, said release line being operative to disengage said second engagement means from said first engagement means responsive to pulling thereof, operative pulling of said release line being facilitated by positioning thereof extending through said longitudinal bore means of said release tubing member;

(3) a first strap means attached with respect to said first securement bracket means and with respect to said second engagement means and being positionable extending around a cylindrical tank for holding thereof within said tank storage zone responsive to engagement of said first engagement means with respect to said second engagement means, said first strap means being adapted to release the cylindrical tank from said tank storage zone responsive to disengagement of said second engagement means from said first engagement means, said first strap means including a first length adjustment means positioned adjacent said first securement bracket means for selectively and independently adjusting the length of said first strap means, said first strap means defining a first intermediate position thereon located intermediate between said second engagement means and said first securement bracket means;

(4) a second strap means attached with respect to said second securement bracket means and with respect to said second engagement means and being positionable extending around a cylindrical tank for holding thereof within said tank storage zone responsive to engagement of said first engagement means with respect to said second engagement means, said second strap means being adapted to release the cylindrical tank from said tank storage zone responsive to disengagement of said second engagement means from said first engagement means, said second strap means adapted to extend around a cylindrical tank within said tank storage zone at a position below said first strap means, said second strap means including a second length adjustment means positioned adjacent said second securement bracket means for selectively and independently adjusting the length of said second strap means, said second strap means defining a second intermediate position thereon located intermediate between said second engagement means and said second securement bracket means;

(5) a webbing panel means of triangular shape which is attached longitudinally along a portion of said first strap means adjacent said first securement bracket means and also being attached longitudinally along a portion of said second strap means adjacent said first securement bracket means to facilitate securing and releasing of a cylindrical tank from said tank storage zone, said webbing panel means defining a first seam area extending longitudinally therealong which is secured to at least a portion of said first strap means to facilitate securing and releasing of a cylindrical tank from said tank storage zone, and wherein said webbing panel means further defines a second seam area extending longitudinally therealong which is secured to at least a portion of said second strap means to also facilitate securing and releasing of a cylindrical tank from said tank storage zone, said webbing panel means being stitched with respect to said first strap means and with respect to said second strap means to facilitate longitudinal engagement with respect thereto, said first seam area of said webbing panel means is sewn to said first strap means longitudinally therealong from a position adjacent said second engagement bracket means to said first intermediate position, said second seam area of said webbing panel means being sewn to said second strap means longitudinally therealong from a position adjacent said second engagement bracket means to said second intermediate position, said webbing panel means being made of a woven polyester material coated with a polyvinyl chloride material, said first seam area of said webbing panel means being secured to said first strap means longitudinally therealong from a position adjacent said second engagement bracket means to said first intermediate position, and said second seam area of said webbing panel means being secured to said second strap means longitudinally therealong from a position adjacent said second engagement bracket means to said second intermediate position; and H. a lower shelf member secured to said backing plate member and extending outwardly therefrom to provide support to a cylindrical tank from beneath thereof responsive to being positioned within said tank storage zone.

* * * * *

UNITED STATES PATENT AND TRADEMARK OFFICE

CERTIFICATE OF CORRECTION

PATENT NO. : 7,503,535 B2
APPLICATION NO. : 11/517895
DATED : March 17, 2009
INVENTOR(S) : Michael Paul Ziaylek It is certified that error appears in the above-identified patent and that said Letters Patent is hereby corrected as shown below:

In claim 13, column 13, line 21, change “aim” to -- arm --.

In claim 13, column 13, line 32, change “aim” to -- arm --.

Signed and Sealed this

Twelfth Day of May, 2009

JOHN DOLL
*Acting Director of the United States Patent and Trademark Office*